US007345571B2

(12) United States Patent
Mizuno

(10) Patent No.: US 7,345,571 B2
(45) Date of Patent: Mar. 18, 2008

(54) THERMALLY-ACTUATED SWITCH

(75) Inventor: Ikuo Mizuno, Nagoya (JP)

(73) Assignee: Ubukata Industries Co., Ltd., Aichi (JP)

( * ) Notice: Subject to any disclaimer, the term of this patent is extended or adjusted under 35 U.S.C. 154(b) by 411 days.

(21) Appl. No.: 10/505,024

(22) PCT Filed: Feb. 17, 2003

(86) PCT No.: PCT/JP03/01678

§ 371 (c)(1),
(2), (4) Date: Jan. 7, 2005

(87) PCT Pub. No.: WO03/071131

PCT Pub. Date: Aug. 28, 2003

(65) Prior Publication Data

US 2005/0104710 A1 May 19, 2005

(30) Foreign Application Priority Data

Feb. 19, 2002 (JP) ..... 2002-041291

(51) Int. Cl.
*H01H 37/52* (2006.01)
*H01H 37/04* (2006.01)

(52) U.S. Cl. ..... 337/381; 337/380

(58) Field of Classification Search ..... 337/380, 337/381; 29/622

See application file for complete search history.

(56) References Cited

U.S. PATENT DOCUMENTS 3,131,322 A * 4/1964 Pleiss, Jr. et al. ..... 337/380
3,246,183 A * 4/1966 Slonneger ..... 310/68 R
3,515,917 A * 6/1970 Kolb ..... 310/71
3,842,297 A * 10/1974 Pleiss et al. ..... 310/68 C
3,959,675 A * 5/1976 Lautner et al. ..... 310/68 C
4,028,570 A * 6/1977 Kieffer et al. ..... 310/68 C (Continued)

FOREIGN PATENT DOCUMENTS

DE 25 38 085 3/1977

(Continued)

OTHER PUBLICATIONS

Russian Office Action dated Aug. 30, 2005 for RU Appln. No. 2004127934 filed Feb. 17, 2003 (original and English translation).

(Continued)

*Primary Examiner*—Anatoly Vortman
(74) *Attorney, Agent, or Firm*—Smith, Gambrell & Russell LLP

(57) ABSTRACT

A thermally-actuated switch mounted on an end of a motor coil of a hermetic motor-driven compressor includes a switch body including a metallic pressure-tight hermetic container, a contact mechanism disposed in the container, and an electrically conductive terminal which hermetically extends through the hermetic container and to which a lead wire is connected, and a holder including a base having a mounting face for the coil end and a holding portion located on a face of the base opposed to the mounting face for holding the switch body. The base is sized so as to prevent radiant heat from transferring from the coil end directly to the switch body. The holder has a through hole through which the terminal is inserted. The lead wire is connected to the terminal having been inserted through the hole so that the holder is held between the hermetic container and the lead wire.

6 Claims, 5 Drawing Sheets

U.S. PATENT DOCUMENTS

| | | | | | |
|---|---|---|---|---|---|
| 4,061,935 | A | * | 12/1977 | Kandpal | 310/68 C |
| 4,112,405 | A | * | 9/1978 | Joseph | 337/4 |
| 4,163,913 | A | * | 8/1979 | Barratt | 310/91 |
| 4,181,393 | A | * | 1/1980 | Lill | 439/402 |
| 4,186,318 | A | * | 1/1980 | Anderson | 310/68 C |
| 4,188,553 | A | * | 2/1980 | Wheaton | 310/68 C |
| 4,250,419 | A | * | 2/1981 | Zolman | 310/68 C |
| 4,328,438 | A | * | 5/1982 | Zolman | 310/68 R |
| 4,571,518 | A | * | 2/1986 | Kintz et al. | 310/68 R |
| 4,791,329 | A | * | 12/1988 | Ubukata et al. | 310/68 C |
| 5,032,749 | A | * | 7/1991 | Stone | 310/68 C |
| 5,615,071 | A | * | 3/1997 | Higashikata et al. | 361/22 |
| 5,723,922 | A | * | 3/1998 | Fowlkes | 310/68 C |
| 5,903,418 | A | | 5/1999 | Boivin et al. | |
| 6,315,528 | B1 | * | 11/2001 | Williams et al. | 417/410.5 |
| 6,326,879 | B1 | * | 12/2001 | Hangmann et al. | 337/381 |
| 6,498,560 | B2 | * | 12/2002 | White et al. | 337/104 |
| 6,548,924 | B2 | * | 4/2003 | Furukawa et al. | 310/68 C |
| 6,744,160 | B2 | * | 6/2004 | Piovesan | 310/68 C |

FOREIGN PATENT DOCUMENTS

| | | | |
|---|---|---|---|
| DE | 2538085 | | 3/1977 |
| EP | 0727864 | | 8/1996 |
| EP | A 0 727 864 | | 8/1996 |
| GB | 1326209 | | 8/1973 |
| JP | 1-198244 | | 8/1989 |
| JP | 4-208047 | A | 7/1992 |
| JP | 10-144-189 | | 5/1998 |
| JP | 10144189 | | 5/1998 |
| JP | 2001 115962 | | 4/2001 |
| JP | 2001-115962 | A | 4/2001 |
| RU | 2 026 582 | C1 | 1/1995 |
| RU | 2 087 980 | C1 | 8/1997 |
| RU | 2 141 697 | C1 | 11/1999 |
| SU | 773775 | | 10/1980 |
| SU | 819842 | A | 4/1981 |
| SU | 1181003 | A | 9/1985 |
| SU | 1501187 | A1 | 8/1989 |

OTHER PUBLICATIONS

Russian Office Action dated Aug. 2006 RU Appln. No. 2004127934 filed Feb 17, 2003 (original and English translation).

Eureopean Examination Report dated Aug. 11, 2006 for EP 03 705 253.7.

Decision on Grant Patent For Invention issued in Russian Application No. 2004127934/09(030270) dated Dec. 19, 2006.

* cited by examiner

THERMALLY-ACTUATED SWITCH

TECHNICAL FIELD

This invention relates to a thermally-actuated switch for protecting an electrically driven hermetic compressor against overheat or burnout.

BACKGROUND ART

Thermally-actuated switches for protecting hermetic motor-driven compressors are classified into an exterior type and an interior type depending upon a mounting manner. The internal type thermally-actuated switch is superior to the exterior type thermally-actuated switch in a response speed to an increase in the temperature of an electric motor constituting the hermetic compressor or a refrigerant filling a hermetic housing of the compressor.

The internal type thermally-actuated switch comprises a switch body including a metal pressure-tight hermetic container and a switching mechanism provided in the container in order that characteristic changes or failure in electric conduction may be prevented even when the switch is exposed to the refrigerant or lubricant in the high-pressure hermetic housing for a long period of time. Accordingly, the switch body (hermetic container) of the thermally-actuated switch is enclosed in an electrically insulating resin case or covered with an electrically insulating covering. In either state, the thermally-actuated switch is mounted in the hermetic housing, for example, on an inner face of the hermetic housing, a hermetic terminal of the motor-driven compressor or a coil end of the electric motor.

When the thermally-actuated switch is mounted on the inner face of the hermetic housing or the hermetic terminal of the motor-driven compressor, a holder needs to be fixed to hold the thermally-actuated switch on the inner face of the hermetic housing or the hermetic terminal. Furthermore, since the inner space of the hermetic housing has recently been rendered as small as possible for the purpose of miniaturization of the compressor, limitations in mounting attitude and location of the thermally-actuated switch and holder are increased.

When the aforesaid thermally-actuated switch is mounted on the coil end of the motor, the hermetic container is covered with a cylindrical electrically insulating covering made from a heat-shrinkable polyester sheet. The thermally-actuated switch covered with the covering is fastened to the coil end with a fastening string made from polyester or the like. The aforesaid fastening string is usually the same as the one binding a coil winding.

The foregoing construction requires no specific component for mounting the thermally-actuated switch on the coil end. Furthermore, the thermally-actuated switch can be accommodated in the hermetic housing of the compressor while being integrated with the coil end.

However, there is a problem that the polyester string is slippery against the insulating coating of polyester sheet. Furthermore, there is another problem that when the cylindrical insulating coating is heat-shrunk, its part not adherent to the hermetic container hardens into indeterminate forms such that the string is difficult to cord up the thermally-actuated switch.

Furthermore, the thickness of the insulating coating is set at a small value of about 0.5 mm in view of the shrinkage characteristic and handling efficiency, so that heat is quickly transferred from the coil end to the thermally-actuated switch. However, since almost entire hermetic container is covered with the insulating covering, heat exchange is retarded between the refrigerant in the hermetic housing and the thermally-actuated switch. Furthermore, a coil with a smaller wire diameter has recently been used for miniaturization of the motor. As a result, an amount of heat generated by the motor is increased as compared with the conventional construction even when an operating current is within a normal range. Accordingly, there is a problem that the thermally-actuated switch is operated to cut off current particularly in the vicinity of an upper limit of the operating current range although the current is equal to or smaller than the operating current. There is further another problem that the thermally-actuated switch susceptibly responds to a temporary sudden increase in the temperature of the motor coil due to a short-period overload condition requiring no protecting operation.

To overcome the aforesaid problems, the applicant invented a thermally-actuated switch comprising a switch body and an electrically insulating holder holding the switch body and filed a patent application therefor (Japanese Laid-open Patent Application No. 2001-115962). The holder has a holding portion accommodating or elastically supporting the switch body. The switch body held by the holder is fastened to the coil end with a fastening string thereby to be fixed.

In the thermally-actuated switch as shown in FIG. 2 of the above-mentioned application, a large part of the surface of the switch body is exposed to the refrigerant. Consequently, heat exchange can be carried out efficiently. However, since radiant heat from the coil end is insufficiently intercepted, the thermally-actuated switch still responds to heat generated by the coil end susceptibly. There is a possibility of malfunction of the thermally-actuated switch particularly when the difference between amounts of heat generated in the normal state and under the abnormal condition is small.

Furthermore, a thermally-actuated switch as shown in FIG. 6 of the above-mentioned application comprises a switch body accommodated in a cylindrical portion. Accordingly, since a covered part of the switch body is increased, heat exchange is insufficient between the thermally-actuated switch and the refrigerant.

Therefore, an object of the present invention is to provide a thermally-actuated switch in which malfunction thereof can be prevented even when the switch is provided in a hermetic motor-driven compressor including a motor coil in which the difference between amounts of heat generated in the normal state and under the abnormal condition is small.

DISCLOSURE OF THE INVENTION

The present invention is a thermally-actuated switch which is provided on an end of a motor coil of a hermetic motor-driven compressor, the thermally-actuated switch comprising a switch body including a metal pressure-tight hermetic container, a contact mechanism provided in the container, and an electrically conductive terminal which hermetically extends through the hermetic container and to which a lead wire is connected and a holder including a base having a mounting face for the coil end and a holding portion provided on a face of the base opposed to the mounting face for holding the switch body, wherein the base is sized so as to prevent radiant heat from transferring from the coil end directly to the switch body, wherein the holder has a through hole through which the terminal is inserted, and wherein the lead wire is connected to the terminal having been inserted through the through hole so that the holder is held between the hermetic container and the lead wire.

According to the foregoing construction, the space defined between the switch body and the coil end can block conductive heat and radiant heat from the coil end. Furthermore, the refrigerant flowing around the switch body can prevent the temperature of the switch body from being excessively increased. Consequently, the thermally-actuated switch can be prevented from excessively responding to the heating of the coil end and from malfunction caused by a short-period overload condition requiring no protecting operation or the like.

BEST MODE FOR CARRYING OUT THE INVENTION

Figure 1:
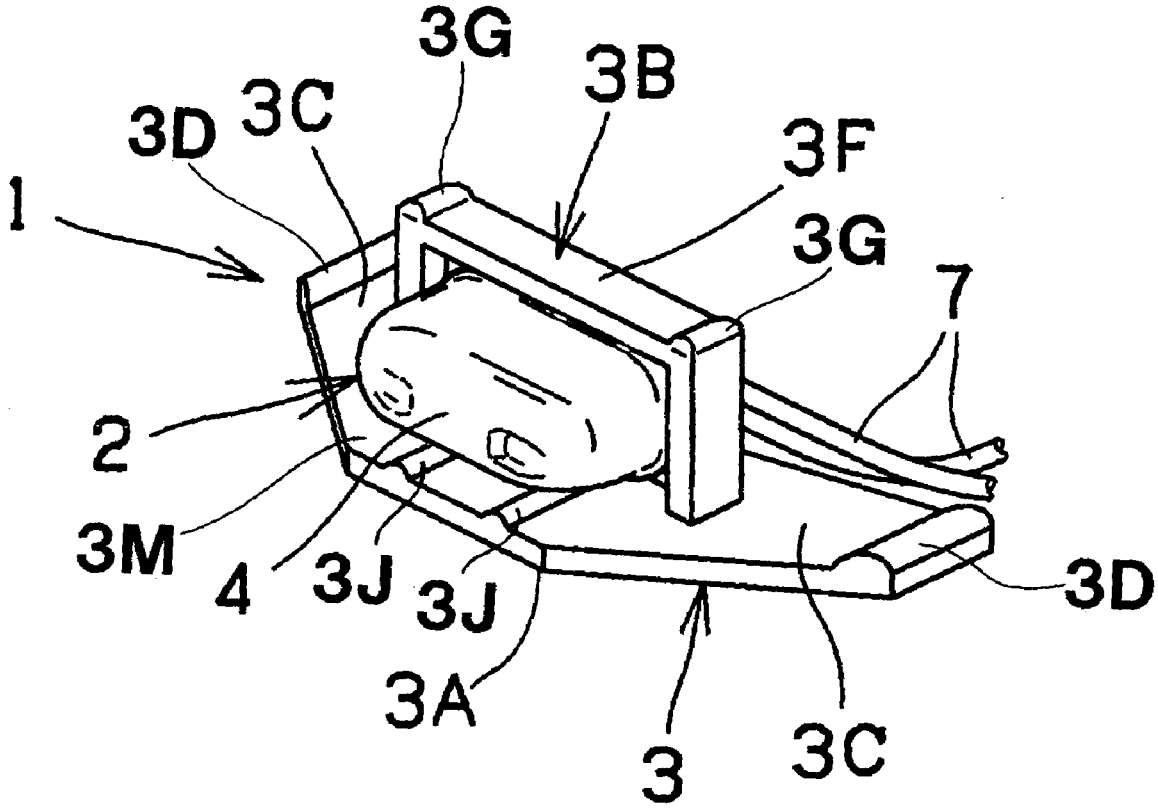
FIG. 1 is a perspective view of the thermally-actuated switch in accordance with a first embodiment of the present invention.
Figure 2:
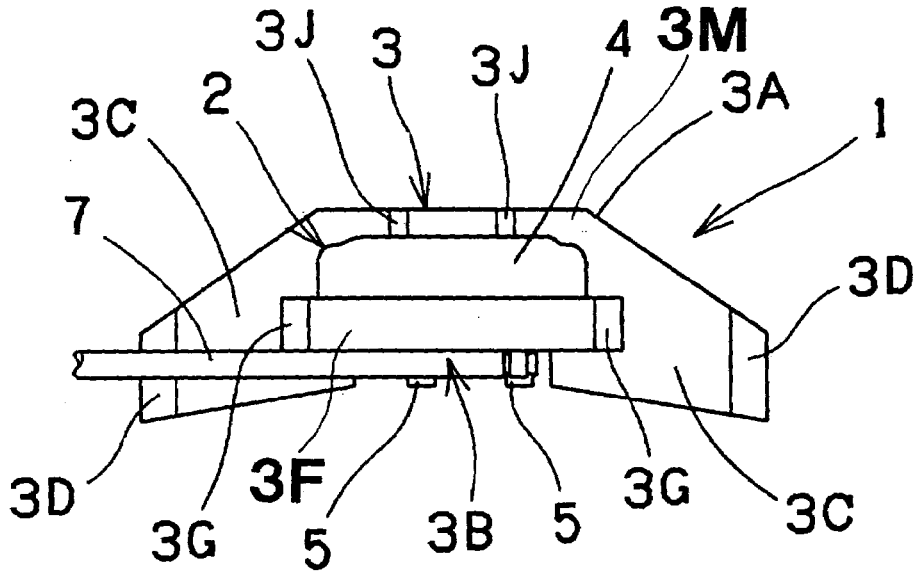
FIG. 2 is a top plan view of the thermally-actuated switch.
Figure 3:
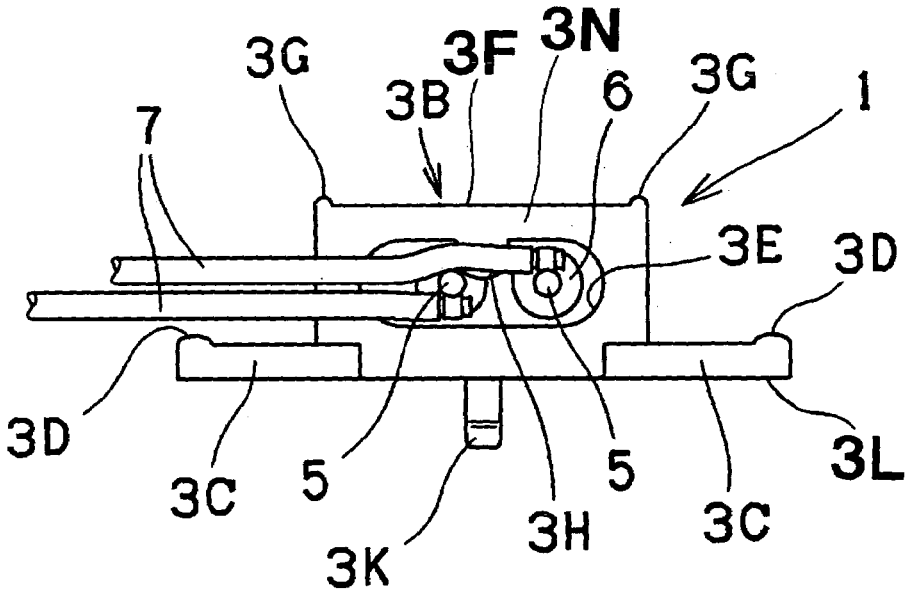
FIG. 3 illustrates the thermally-actuated switch as viewed from the holder wall side.
Figure 4:
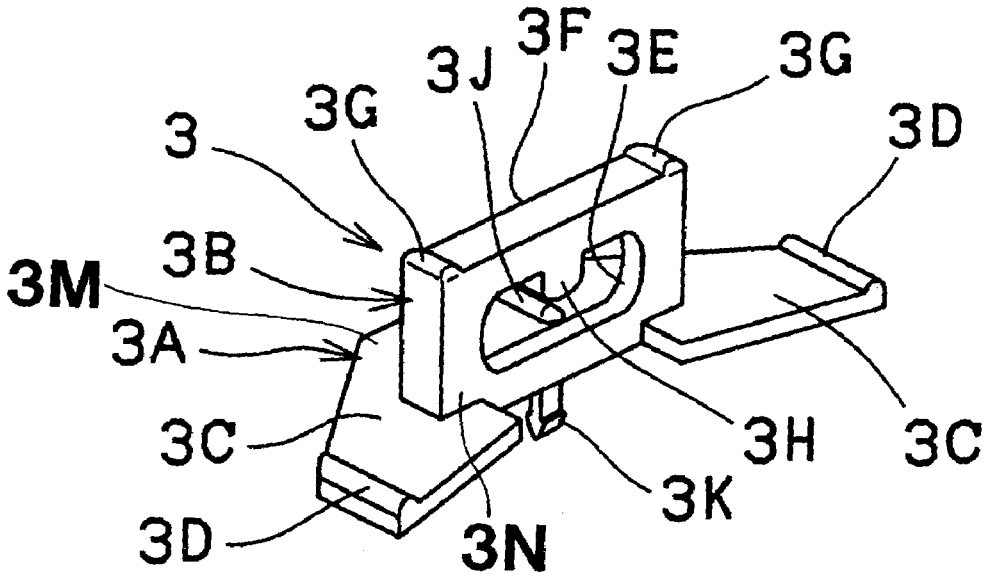
FIG. 4 is a perspective view of the holder as viewed at one side.
Figure 5:
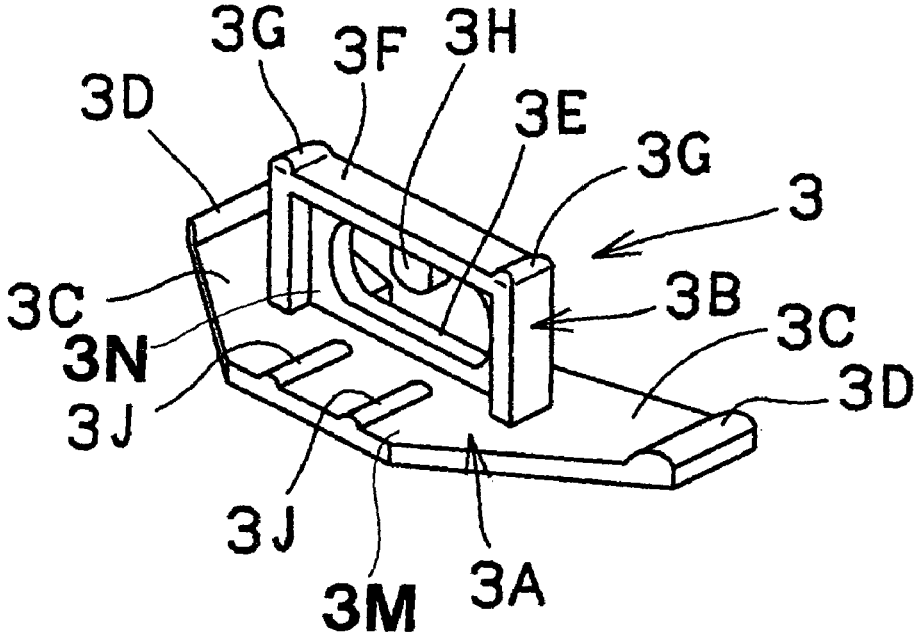
FIG. 5 is a perspective view of the holder as viewed at another side.
Figure 6:
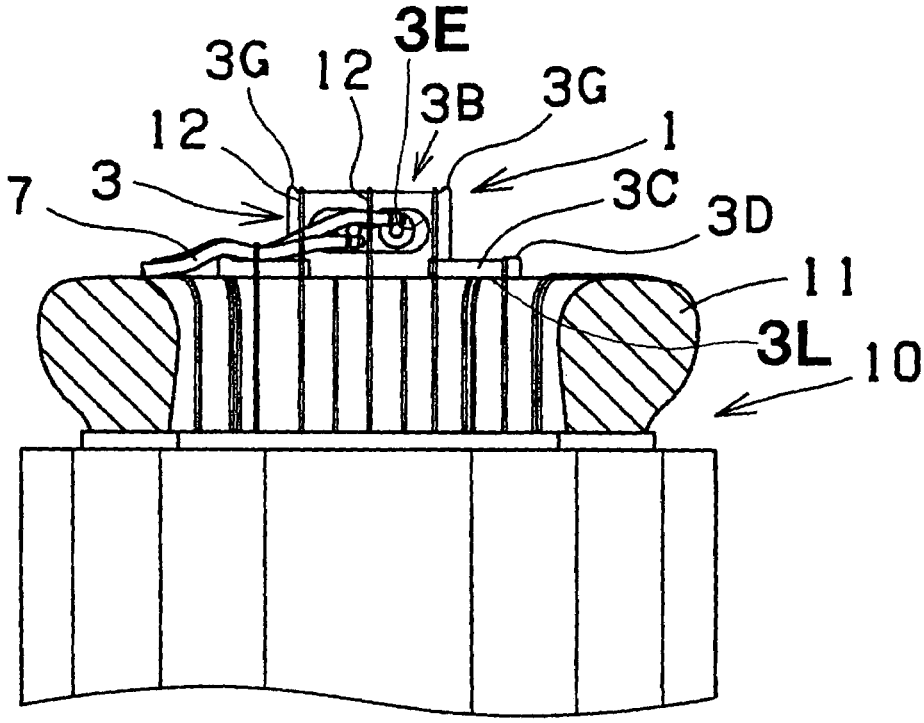
FIG. 6 illustrates the thermally-actuated switch mounted on the coil end as viewed from the inner circumference of the coil.
Figure 7:
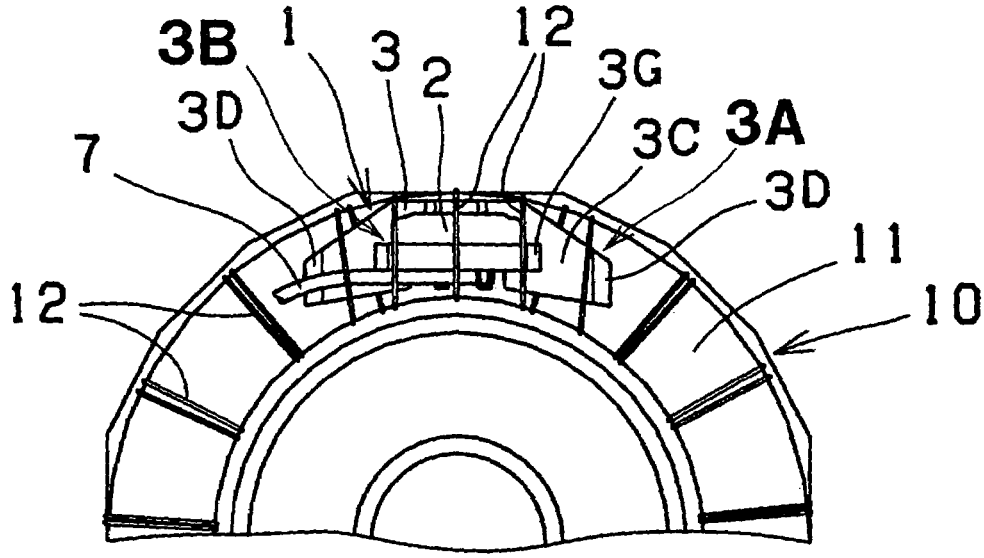
FIG. 7 is a top view of the thermally-actuated switch mounted on the coil end.

The present invention will be described in more detail with reference to the accompanying drawings. A first embodiment of the invention will be described with reference to FIGS. 1 to 7. FIGS. 1 to 3 show an overall construction of the thermally-actuated switch in accordance with the embodiment, FIGS. 4 and 5 show a holder of the thermally-actuated switch, FIGS. 6 and 7 show the thermally-actuated switch mounted on a coil end.

Referring to FIGS. 1 to 3, the thermally-actuated switch 1 comprises a switch body 2 and a holder 3. The switch body 2 includes a metallic pressure-tight hermetic container 4 and a contact mechanism (not shown) provided in the container 4. The contact mechanism opens and closes contacts by a thermally-actuated member such as bimetal.

Two electrically conductive terminals 5 protrude from one end face of the container 4. The terminals 5 extend through through-holes (not shown) formed in an end of the container 4. A gap between each terminal 5 and the corresponding through-hole is filled with an electrically insulating filler 6 such as glass, whereupon the each terminal 5 is hermetically fixed to the container 4. Lead wires 7 are conductively fixed to the terminals 5 by welding or the like respectively.

The holder 3 is made of an electrically insulating material such as synthetic resin, ceramics or the like. The holder 3 includes a flat plate-shaped base 3A and a holding portion 3B standing on one of sides or an upper side of the base 3A. The other side or underside of the base 3A serves as a mounting face 3L.

The base 3A has a thickness set at about 2 mm in order that a sufficient strength and heat insulation may be obtained from the base 3A. The base 3A includes a mount portion 3M on which the holding portion 3B stands and on which the switch body 2 is mounted and tapered fixing portions 3C provided on both ends of the mount portion 3M respectively. The mount portion 3M is large enough to prevent the switch body 2 mounted thereon from extending out of the mount portion. In the embodiment, the mount portion 3M and fixing portions 3C or the entire base 3A serves as a heat-shielding portion.

Two protruding bars 3J are provided on the upper side of the mount portion 3M. Further, an insertion protrusion 3K is provided on the underside of the mount portion 3M for temporarily fixing the holder 3 to a coil end of an electric motor 10 (see FIGS. 6 and 7). A convex engaging portion 3D is provided on a distal end of the fixing portion 3C. The fixing portion 3C is constructed to be inclined to one side toward the distal end so as to conform to an annular shape of the coil end 11 when the base 3A (holder 3) is fixed to the coil end 11 of the motor 10 (see FIGS. 6 and 7). Particularly in the embodiment, the fixing portion 3C includes lower and upper side portions disposed at inner and outer circumferential sides of the motor coil respectively. The lower and upper side portions of each fixing portion 3C have different inclinations (see FIG. 2). As a result, the base 3A can be disposed on the coil end without extending out of the upper side of the coil end even though various coil ends have different diameters.

The holding portion 3B includes a wall 3N substantially perpendicular to the base 3A and a flange 3F formed on an upper end and both sides of the wall 3N. The wall 3N is formed with an elliptic through-hole 3E through which the terminals 5 extend. The through-hole 3E is rendered as large as possible in order that heat exchange may desirably be carried out between a refrigerant and the container 4. A downwardly extending protrusion 3H is provided on an upper inner peripheral edge of the through-hole 3E. Convex engaging portions 3G are formed on both ends of the top of the flange 3F respectively.

The switch body 2 is fixed to the holder 3 as described above in the following manner. The terminals 5 are inserted through the through-hole 3E and one end of the container 4 is abutted against the wall 3N. As a result, the end of the container 4 is fitted into the holding portion 3B. At this time, the protrusion 3H is disposed between the two terminals 5. Further, a space through which the refrigerant can flow is defined between the container 4 and the mount portion 3M by the protruding bars 3J.

Continuously, the lead wires 7 are fixed to the terminals 5 of the switch body 2 set in the holder 3 respectively, whereupon the lead wires 7 abut the end of the container 4 against the wall 3N relatively harder such that the switch body 2 is fixed to the holder 3. Although the switch body 2 is incompletely fixed to the holder 3 in this state, the switch body 2 can sufficiently be prevented from falling off from the holder 3 when the thermally-actuated switch 1 is mounted on the coil end as will be described later. Further, since the protrusion 3H is located between the terminals 5, the protrusion 3H is surrounded by the terminals 5, container 4 and lead wires 7. Accordingly, the switch body 2 is held while positioned relative to the holder 3.

It is suggested that the holder 3 be made of an elastic material so as to elastically hold the switch holder 3. However, the holder 3 necessitates a heat resistance and resistance to the refrigerant. When the holder 3 further necessitates elasticity, too, a range of choice is narrowed regarding the material for the holder 3. On the other hand, no elasticity is required of the holder 3 as the result of the above-described construction in the foregoing embodiment. Consequently, the freedom in a range of choice is increased regarding the material for the holder 3.

Mounting the thermally-actuated switch 1 on the coil end 11 will now be described with reference to FIGS. 6 and 7. Firstly, the thermally-actuated switch 1 is placed on the coil end 11 of the motor 10 so that the mounting face 3L of the base 3A abuts against the upper side of the coil end 11. At this time, the insertion protrusion 3K is inserted into the space between the windings of the coil end 11, whereby the thermally-actuated switch 1 is temporarily fixed to the coil end 11.

The thermally-actuated switch 1 temporarily fixed to the coil end 11 is further fixed by a fastening string 12 made from polyester or the like. At this time, the fastening string 12 hung on the thermally-actuated switch 1 is prevented from detaching from the holder 3 by the engaging portions 3D and 3G. When the thermally-actuated switch 1 is thus fixed to the coil end 11, the base 3A is positioned between the switch body 2 and the coil end 11. Moreover, the base 3A is sized so that the switch body 2 disposed on the upper side of the base 3A is prevented from protruding from the coil end 11 and so that the switch body 2 is shielded from radiant heat from the coil end 11. Consequently, a conductive heat and radiant heat from the coil end can be prevented from directly reaching the switch body 2.

Furthermore, the base 3A is formed into the shape of a flat plate and a portion of the base 3A covering the switch body 2 is reduced as much as possible. Consequently, heat exchange between the switch body 2 and the refrigerant can be carried out easily while the switch body 2 is shielded from the radiant heat from the coil end 11.

Furthermore, the through-hole 3E is rendered as large as possible so that the switch body 2 is readily brought into contact with the refrigerant. Further, the protruding bars 3J are provided on the upper side of the mount portion 3M so that the space through which the refrigerant flows is secured between the container 4 and the base 3A. Accordingly, since the heat exchange is efficiently carried out between the container 4 and the refrigerant, the thermally-actuated switch 1 can quickly respond to the changes in the temperature of the refrigerant.

Furthermore, since the thickness of the holder 3 is increased and the space is secured between the coil end 11 and the base 3A, heat from the coil end 11 is less transferable via the base 3A to the switch body 2. Consequently, the switch body 2 can be prevented from an excessive response to a temporary and sudden temperature increase due to a short-period overload condition not requiring heat generation and protection of the coil end 11 during a normal operation, for example.

Additionally, the base 3A is constructed so as to conform to the flat shape of the coil end 11 and the thermally-actuated switch 1 is constructed so as not to protrude from the base 3A. Consequently, the thermally-actuated switch 1 can be prevented from protruding from the coil end 11 to interfere with the hermetic housing of the compressor.

Figure 8:
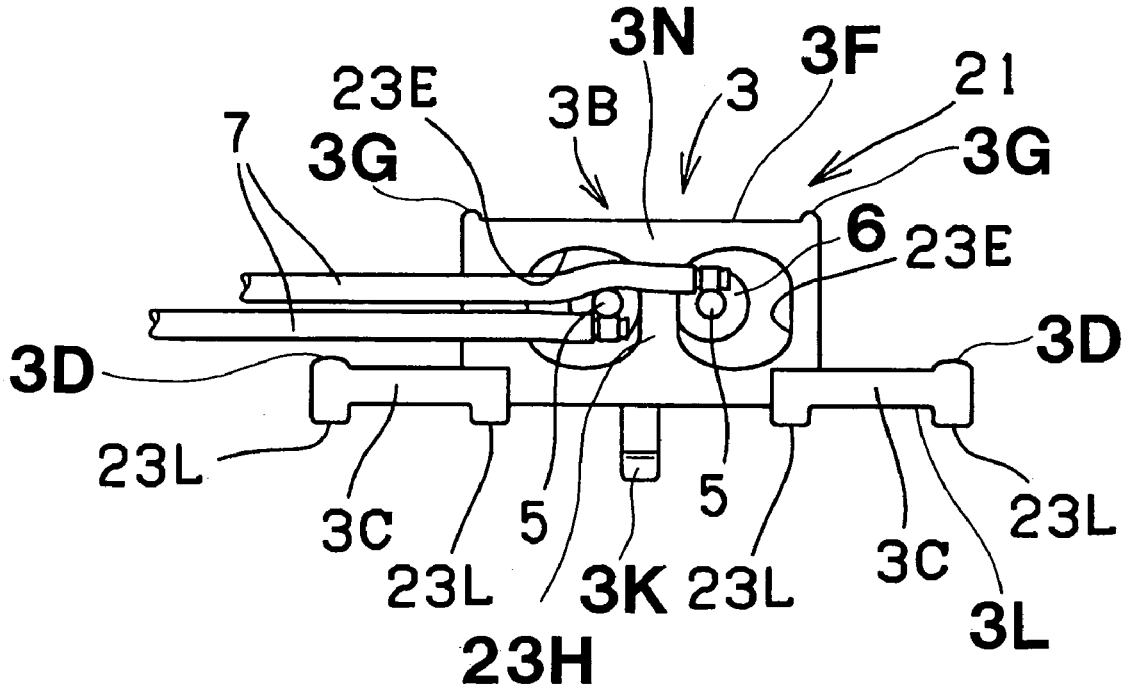
FIG. 8 is a view similar to FIG. 3, showing the thermally-actuated switch in accordance with a second embodiment of the present invention.

FIG. 8 illustrates a second embodiment of the invention. Only the difference of the first and second embodiments will be described. In the second embodiment, identical or similar parts are labeled by the same reference symbols as those in the first embodiment. The thermally-actuated switch 21 of the second embodiment is provided with two through-holes 23E formed in the holding portion 3B of the holder 3. The through-holes 23E correspond to the locations of the two terminals 5 respectively.

Thus, since the two through-holes are provided, a middle portion 23H located between the through-holes 23E is surrounded by the terminals 5, container 4 and lead wire 7. Accordingly, the switch body 2 can reliably be positioned relative to the holder 3 as in the same manner and held as in the first embodiment.

Furthermore, in the embodiment, the spacers 23L serving as upheavals are provided on the mount face 3L of the base 3C. The spacers 23L are provided on the lower portions of the engaging portions 3D and 3G in view of a force applied to the thermally-actuated switch 21 when the fastening string 12 is hung on the thermally-actuated switch 21 so that the latter is fixed. A space through which the refrigerant is allowed to flow is defined between the coil end 11 and the base 3A when the thermally-actuated switch 1 has been disposed on the coil end 11 by the spacers 23L. Accordingly, since a contact area of the base 3A with the coil end 11 is reduced, heat from the coil end 11 can further be prevented from transferring through the base 3A to the switch body 2.

The present invention should not be limited by the foregoing embodiments but may be modified as follows. The base 3A may have a thickness of not less than 1 mm. Consequently, a sufficient strength and heat insulation can be achieved.

In order that the fastening string 12 may be prevented from being detached from the holder 3, the upper sides of the holding portion 3B and fixing portion 3C may be corrugated, instead of provision of the engaging portions 3D and 3G.

The number of terminals should not be limited to two but may be three or more. Further, the metal container may serve as the terminal.

INDUSTRIAL APPLICABILITY

As described above, the thermally-actuated switch of the present invention is useful as a device which is provided on a coil end of an electric motor constituting a hermetic motor-driven compressor and which protects the motor against overheat and burning, and more particularly, suitable for use in a compressor in which the motor coil has a small difference between temperatures under normal and abnormal conditions.

The invention claimed is:

1. A thermally-actuated switch which is provided on an end of a motor coil of a hermetic motor-driven compressor, the thermally-actuated switch comprising:

a switch body including a metallic pressure-tight hermetic container, a contact mechanism provided in the container, and an electrically conductive terminal which hermetically extends through the hermetic container and to which a lead wire is connected; and a holder including a base having a mounting face for the coil end and a holding portion provided on a face of the base opposed to the mounting face for holding the switch body, wherein the base is sized so as to prevent radiant heat from transferring from the coil end directly to the switch body, wherein the holder has a through hole through which the terminal is inserted, and wherein the lead wire is connected to the terminal having been inserted through the through hole so that the holder is held between the hermetic container and the lead wire.

2. The thermally-actuated switch of claim 1, wherein said holder includes a protrusion provided on a peripheral edge of the through hole so as to protrude into the through hole and the protrusion is held between the hermetic container and the lead wire.

3. The thermally-actuated switch of claim 2, wherein the switch body is provided with at least two terminals and the protrusion is located between the terminals.

4. The thermally-actuated switch of claim 1, wherein the switch body is provided with a plurality of terminals, the holder has a plurality of through holes corresponding to the terminals respectively, and the lead wires are connected to the terminals having been inserted through the through holes respectively so that the holder is held between the hermetic container and the lead wires.

5. The thermally-actuated switch of claim 1, wherein the mounting face of the base is provided with an upheaval defining a space between the mounting face and the coil end so that a refrigerant is allowed to flow through the space when the holder is mounted on the coil end.

6. The thermally-actuated switch of claim 1, wherein the base is formed into a flat shape.

* * * * *